US009611994B2

(12) United States Patent
Bauer et al.

(10) Patent No.: US 9,611,994 B2
(45) Date of Patent: Apr. 4, 2017

(54) VEHICLE HEADLIGHT WITH LASER LIGHT SOURCE

(71) Applicant: ZIZALA LICHTSYSTEME GMBH, Wieselburg (AT)

(72) Inventors: Friedrich Bauer, Bergland (AT); Andreas Moser, Haag (AT); Johann Altmann, Gmund (AT); Erich Kaufmann, Linz (AT)

(73) Assignee: ZKW GROUP GMBH, Wieselburg an der Erlauf (AT)

( * ) Notice: Subject to any disclaimer, the term of this patent is extended or adjusted under 35 U.S.C. 154(b) by 131 days.

(21) Appl. No.: 14/353,309

(22) PCT Filed: Feb. 28, 2013

(86) PCT No.: PCT/AT2013/050051

§ 371 (c)(1),
(2) Date: Apr. 22, 2014

(87) PCT Pub. No.: WO2013/134804

PCT Pub. Date: Sep. 19, 2013

(65) Prior Publication Data

US 2014/0321148 A1 Oct. 30, 2014

(30) Foreign Application Priority Data

Mar. 12, 2012 (AT) ..... A 50070/2012

(51) Int. Cl.
*F21S 8/10* (2006.01)

(52) U.S. Cl.
CPC ..... *F21S 48/1145* (2013.01); *F21S 48/1104* (2013.01); *F21S 48/1159* (2013.01);
(Continued)

(58) Field of Classification Search
CPC ..... F21S 48/10; F21S 48/11; F21S 48/1104; F21S 48/1109; F21S 48/1113;
(Continued)

(56) References Cited

U.S. PATENT DOCUMENTS 6,994,454 B2 * 2/2006 Kinouchi ..... B60Q 1/12 362/301
8,183,991 B2 * 5/2012 Yagi ..... B60Q 1/0035 250/338.1

(Continued)

FOREIGN PATENT DOCUMENTS

DE 102007016442 A1 10/2008
DE 102008008664 A1 9/2009

(Continued)

OTHER PUBLICATIONS

International Preliminary Report on Patentability—PCT/AT2013/050051, dated Feb. 21, 2014.

*Primary Examiner* — Evan Dzierzynski
*Assistant Examiner* — Gerald J Sufleta, II
(74) *Attorney, Agent, or Firm* — Eversheds Sutherland (US) LLP

(57) ABSTRACT

The invention relates to a vehicle headlight (1) comprising at least one laser light source (2), at least one luminous element (3) that may be stimulated to emit visible light which can be irradiated by means of the laser light source (2), and at least one imaging optical element, for example a reflector (4) and/or a lens, wherein the laser light source (2) is disposed in front of the luminous element (3) as viewed in the main beam direction (100) of the vehicle headlight (1) such that the light from the laser light source (2) radiates in the opposite direction to the main beam direction (100) of the vehicle headlight (1).

10 Claims, 1 Drawing Sheet

Figure 1:
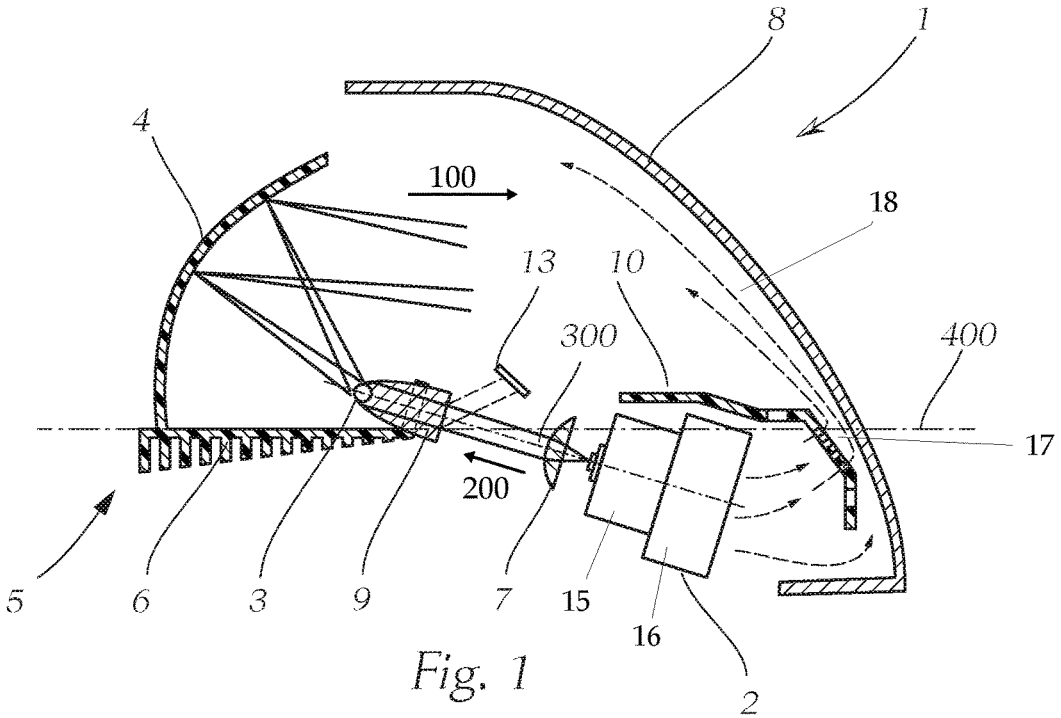

(52) U.S. Cl.
CPC ..... *F21S 48/321* (2013.01); *F21S 48/34* (2013.01); *F21S 48/1241* (2013.01); *F21S 48/325* (2013.01)

(58) Field of Classification Search
CPC F21S 48/1118; F21S 48/1122; F21S 48/1145; F21V 7/005; F21V 7/0058; F21V 7/0066
USPC ..... 362/475–476, 507, 516
See application file for complete search history.

(56) References Cited

U.S. PATENT DOCUMENTS

| | | | | |
|---|---|---|---|---|
| 2011/0292636 | A1 | 12/2011 | Fukai | |
| 2012/0106188 | A1* | 5/2012 | Takahashi | F21S 48/1241 362/516 |
| 2012/0140501 | A1* | 6/2012 | Nakazato | F21S 48/1145 362/510 |
| 2012/0163009 | A1* | 6/2012 | Nakazato | F21S 48/1145 362/510 |
| 2012/0224384 | A1* | 9/2012 | Takahira | F21V 9/16 362/509 |
| 2013/0314937 | A1* | 11/2013 | Takahashi | F21S 48/10 362/538 |

FOREIGN PATENT DOCUMENTS

| | | | |
|---|---|---|---|
| EP | 1459934 | A2 | 9/2004 |
| JP | 2004241142 | A | 8/2004 |
| JP | 2008060030 | A | 3/2008 |
| JP | 2011181381 | A | 9/2011 |
| WO | 2012076294 | A2 | 6/2012 |

* cited by examiner

VEHICLE HEADLIGHT WITH LASER LIGHT SOURCE

The invention relates to a vehicle headlight comprising at least one laser light source, at least one luminous element configured to be stimulated to emit visible light which can be irradiated by means of the laser light source, and at least one imaging optical element, for example a reflector and/or a lens.

Various types of vehicle headlights are known in the prior art, wherein headlights comprising discharge lamps and halogen light sources were used predominantly in recent years. In order to save energy and further reduce the amount of space required by vehicle headlights, efforts are increasing to utilize laser light sources such as semiconductor lasers, since these are advantageous in this regard. In order to render the laser light usable for a vehicle headlight, a luminous element, namely a phosphor converter (e.g. a phosphorous compound or a cerium-doped YAG crystal) is irradiated with a laser light source, wherein this luminous element is thereby stimulated to emit visible light. The phosphor converter therefore converts laser light into light having other wavelengths.

Document US 2011/0194302 A1, for example, shows such a light source, in the case of which a laser diode radiates onto a fluorescent substance from behind, via a light guiding element, wherein this fluorescent substance then emits visible light, which is directed into the direction of travel by means of a reflector screen. The laser light sources that are used emit energies of up to 3 W in the main beam direction of the headlight, wherein, in the event of a malfunction of to damage to the headlight, it is possible for highly intensive, eye-damaging laser light radiation to result in injury or at least pose a hazard to other drivers.

A problem addressed by the invention is therefore that of providing a vehicle headlight comprising a laser light source that is not hazardous to other drivers in any situation of use.

This problem is solved according to the invention by an initially mentioned vehicle headlight in that the laser light source is disposed in front of the luminous element as viewed in the main beam direction of the vehicle headlight such that the light from the laser light source radiates in the opposite direction to the main beam direction of the vehicle headlight.

Since the vehicle headlight according to the invention radiates the laser beams in the opposite direction to the main beam direction, the laser beams cannot emerge even in the event of a malfunction of or damage to the headlight. Therefore, other drivers are not put at risk when the headlight is damaged in an accident, for example. Various light distributions can be generated depending on the arrangement of the laser light source and the luminous element relative to one another or depending on the arrangement of the luminous element in or relative to the imaging optical element (e.g. reflector, lens).

The invention makes it possible to implement a vehicle headlight that can meet the legal requirements, such as ECE, SAE, CCC, etc.

Advantageously, the beam direction of the laser light source extends at an angle between 0° and 90° with respect to the optical axis of the vehicle headlight. The laser light source can therefore be disposed in various ways, depending on the available installation space and the application. The advantage of radiating in the opposite direction to the main beam direction of the headlight and, therefore, protecting other drivers in the event of damage or malfunction is therefore ensured.

The laser light source is disposed, relative to the luminous element, on an envelope of a right circular cone, wherein the tip of the circular cone is located in the luminous element, the cone axis extends parallel to the optical axis of the vehicle headlight, and the envelope line of the envelope of the cone, on which the laser light source is disposed, extends parallel to the beam direction of the laser light source. The laser light source can therefore be positioned in a variety of ways, wherein this laser light source can be disposed, on the surface line thereof, either in the region of the cone base or in any position between the cone tip and the point of intersection between the cone tip and the base.

Advantageously, the luminous element is disposed on the optical axis of the vehicle headlight. In one variant of the invention, the luminous element is disposed in a focal point of the reflector. It is thereby possible to ensure optimal utilization of the light emitted by the luminous element and obtain high luminance.

In a further variant of the invention, at least one lens element, in particular a positive lens element, is disposed between the laser light source and the luminous element. The radiation of the laser light into the luminous element can therefore be optimized, in particular with respect to the distribution of excitation energy in the luminous element. The energy of the laser light source can therefore be concentrated, advantageously, onto or into the luminous element. In addition, by concentrating the light onto the luminous element, it is ensured that, due to the resultant tolerances, the luminous element is struck by the laser light in accordance with the invention and the headlight illuminates, even in the event of vibration-related, minimal displacements of the light source.

Advantageously, the laser light source is disposed underneath a horizontal plane which, in the installed state of the vehicle headlight, extends through the optical axis of the vehicle headlight. A large amount of dissipated heat is usually generated during operation of laser light sources. In one variant of the invention, the vehicle headlight comprises a cover panel and the laser light source is disposed so close to the cover panel that the cover panel can be heated by the heat dissipated from the laser light source. Therefore, the heat dissipated from the laser light source can be used to thaw or de-ice the cover panel of the vehicle headlight.

In one variant of the invention, the laser light source comprises at least one heat sink and/or at least one ventilation device. Therefore, heat produced by the laser light source can be effectively dissipated during operation. In this case, the heat sink comprises, for example, a thermally conductive material, the top surface of which can be provided with additional heat-dissipating elements such as cooling fins. The ventilation device can be a ventilation device, for example, by means of which cool air can be delivered to the heat sink or the laser light source and, simultaneously, warm air can be dissipated.

Advantageously, at least one design screen element is provided, which encloses the laser light source for vision protection. This design screen element can be embodied as a cover for or enclosure of the laser light source and is used, inter alia, to ensure that the laser light source is not visible from the outside. The laser light source is disposed within or underneath this design screen element. In one variant of the invention, the design screen element comprises at least one design screen opening, which is preferably in the form of a nozzle. The design screen opening is advantageously oriented in the direction of a cover panel of the vehicle headlight. It is therefore possible to direct the heat dissipated from the laser light source in the direction of the cover panel as described above, for example. The expression "in the form of a nozzle" refers, in this case, to an embodiment that makes it possible to orient the air flow passing through the design screen opening.

Basically, the stated invention can be implemented as a general-diffuse concept, i.e. the laser light source radiates directly onto the luminous element. In one variant of the invention, at least one light guiding element is disposed between the laser light source and the luminous element. The light guiding element is used primarily to compensate for deviations in the beam direction of the laser light source from the ideal beam direction such that the light from the laser light source is optimally guided in the direction of the luminous element (or is bundled, depending on the embodiment of the light guiding element). The light guiding element comprises a light guiding material, for example a plastic such as polycarbonate (PC) or polymethyl methacrylate (PMMA—or Plexiglas) or glass, and have any shape, for example tubular, conical, or cylindrical. An embodiment as a funnel-shaped concentrator element, made of glass, for example, is also possible, wherein the total reflection at the boundary surfaces of the concentrator element is utilized as in the case of a light rod. The light guiding element can be provided with irregularities (in the form of microstructures) on the surface, for example, wherein these irregularities redirect the laser light and thereby induce illumination of the light guiding element, which may be used as a design element. When a blue laser light source is used, for example, a blue illumination that is not harmful to the eyes can be produced in this manner.

In one variant of the invention, as least one screen element is provided as a shield against laser light emerging from the vehicle headlight. Such screen elements can be provided with an absorbing or light-impermeable surface, or with a surface that prevents laser light from passing through. For example, these screen elements can be disposed in regions at which laser light could otherwise emerge from the vehicle headlight due to reflection, or the screen element can be embodied as a device that encloses the laser beam (or the aforementioned light guiding elements).

Figure 2:
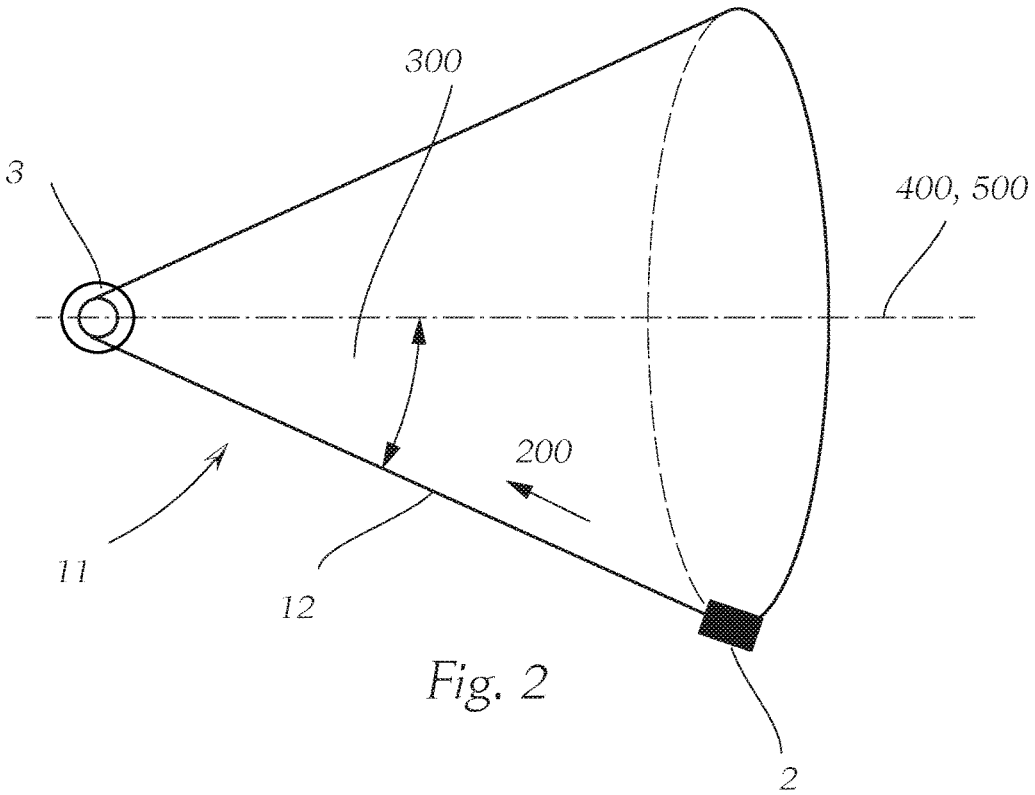

The invention is described in greater detail in the following by reference to a non-restrictive exemplary embodiment shown in the drawing. Therein:

FIG. 1 shows a schematic, cross-sectional view of a section of a vehicle headlight according to the invention; and FIG. 2 shows a schematic representation of the possible relative arrangement of the laser light source and the luminous element according to one variant of the invention.

Identical elements are provided with the same reference signs in the figures. The designations "front, rear", etc., that are used in the following, in part, always refer to the installed position of a vehicle headlight or to a vehicle headlight in the installed state.

FIG. 1 shows a cross-sectional view of a section of a vehicle headlight 1. Only those features are shown that are essential to the understanding of the invention, since a person skilled in the art is familiar with the remaining elements of a vehicle headlight.

The vehicle headlight 1 comprises a laser light source 2, which radiates in a wavelength range between 200 nm and 450 nm, for example, i.e. partially in the non-visible UV range. The power of the laser light source 2 is currently between 0.5 and 2 W, although this can be greater. The laser light source 2 is a semiconductor laser, for example, in the form of a laser diode or a VCSEL (Vertical Cavity Surface Emitting Laser). It is also possible to provide a plurality of laser light sources 2, for example in the form of laser diode arrays.

In order to dissipate heat produced during operation, the laser light source 2 comprises, in the exemplary embodiment shown, a heat sink 15 and a ventilation device 16, wherein the ventilation device 16 is used in this case to supply cool air to the heat sink 15 and dissipate warm air from this heat sink. The ventilation device 16 can comprise a ventilation element, for example. The heat sink 15 can be made of a suitable material and can also comprise cooling fins or the like.

In addition to the laser light source 2 (shown in FIG. 1 with heat sink 15 and fan 16), a luminous element 3 is provided, which is spherical in the present exemplary embodiment. The spherical shape is only one of several possible shapes; the luminous element 3 can also have a different design. The luminous element 3 is preferably a phosphor converter, which can be stimulated by the light of the laser light source 2 to emit visible light, in a manner that is known. Basically any material that converts monochromatic laser light into light having other wavelengths (preferably white light, which results due to superimposition) can be used as phosphor converters.

In principle, the phosphor convertor is therefore a light transformer, i.e. the electrons of the converter material are excited by the laser light to higher energy levels and, upon dropping back down, these electrons emit light having the wavelength corresponding to the difference between the levels.

The luminous element 3 is disposed in a reflector 4, which directs the light emitted by the luminous element 3 in the main beam direction 100 of the vehicle headlight. As shown in FIG. 1, the main beam direction 100 extends from the left to the right in the present example. The reflector 4 can be swivellable and/or adjustable, which is not depicted in the figures, for clarity. Basically any embodiments of the reflector 4 are possible, wherein free-form variants as well as parabolas, hyperbolas, ellipses, or combinations thereof may be used for the reflector surface. In FIG. 1, the reflector 4 is shown in a cross-sectional view and can be embodied as a half-shell (wherein only the top half or the lower half is present) or as a full reflector, wherein a person skilled in the art is familiar with several variants for the reflector 4.

In the variant of the invention shown, the luminous element 3 is disposed on the optical axis 400 of the vehicle headlight 1 in a focal point of the reflector 4. It is pointed out that the reflector 4 can also be embodied as a free-surface reflector having a plurality of different focal points, wherein, according to the exemplary embodiment shown, the luminous element 3 is disposed in precisely one of these focal points. It is not absolutely necessary, of course, for the luminous element 3 to be disposed in one focal point; however, in order to achieve a desired light distribution, this luminous element must remain fixed in position in the reflector, and this must also be ensured in the case of vibrations. The vehicle headlight 1 is closed by means of a cover panel 8. The cover panel 8 can have any design, but is preferably largely transparent.

The desired light pattern of the vehicle headlight 1 is produced by means of the luminous element 3 and the reflector 4. A carrier element 5 for fastening the luminous element 3 is provided in the reflector 4. In this case, the carrier element 5 is provided with cooling fins 6, which are used to dissipate the heat produced in the luminous element by the generation of light. The cooling fins 6 are merely one example of heat-dissipating elements that can be used in this case. A person skilled in the art is familiar with several possibilities in this regard, which will therefore not be discussed in greater detail.

According to the invention, the laser light source 2 and the luminous element 3 are disposed such that the light from the laser light source 2 radiates in the opposite direction to the main beam direction 100 of the vehicle headlight 1. The beam direction 200 of the laser light source 2 therefore extends in the opposite direction to the main beam direction 100 of the vehicle headlight 1. It is thereby ensured that the light from the laser light source 2 cannot deviate and pose a hazard to other drivers in the event of damage to the vehicle headlight 1 or a malfunction.

The beam direction 200 of the laser light source 2 preferably extends at an acute angle 300 with respect to the main beam direction 100 of the vehicle headlight 1 or the optical axis 400 thereof. The angle 300 can therefore be between 0° and 90°. An angle of 0° therefore means that the laser light source 2 is disposed on the optical axis 400 of the vehicle headlight 1 behind the luminous element 3 as viewed in the main beam direction 100. Similarly, an angle 300 of 90° means that the beam direction 200 of the laser light source 2 is normal to the optical axis 400 of the vehicle headlight 1. The optical axis 400 and the main beam direction 100 of the vehicle headlight 1 extend substantially parallel to one another. The light source 2 and the luminous element 3 can therefore be disposed relative to one another in a manner depending on the installation space that is available for the vehicle headlight 1 and depending on the desired application.

The arrangement of the laser light source 2 relative to the luminous element 3 can be substantially described, in an abstract sense, by reference to a circular cone. As is evident from FIG. 2, the laser light source 2 is disposed, relative to the luminous element 3, on an envelope of a right circular cone 11, wherein the tip of the circular cone is located in the luminous element 3, the cone axis 500 extends parallel to the optical axis 400 of the vehicle headlight 1, and the envelope line 12 of the envelope of the cone, on which the laser light source 2 is disposed, extends parallel to the beam direction 200 of the laser light source 2. In principle, the laser light source 2 can be disposed at any point on the envelope line 12 dedicated thereto, i.e. either at the point where the envelope line intersects the base or bottom of the circular cone 11 or anywhere between this point of intersection and the luminous element 3. The angle 300 between the beam direction 200 of the laser light source 2 and the optical axis 400 of the vehicle headlight, or between the envelope line 12 and the cone axis 500, is half the angle of opening of the circular cone 11. The shape of the circular cone therefore changes depending on the value selected for the angle 300.

A number of elements can be disposed between the laser light source 2 and the luminous element 3. For example, in the exemplary embodiment shown according to FIG. 1, an optical element in the form of a positive lens element 7 is disposed directly behind the laser light source 2. This positive lens concentrates the light from the laser light source 2 in the direction of the luminous element 3. It is also possible, of course, to use any other types of optical elements, for example highly diverse types of lenses and/or prisms.

A light guiding element 9 is provided directly in front of the luminous element 3, or this light guiding element holds the luminous element 3, wherein, in the exemplary embodiment shown, this light guiding element 9 is substantially funnel-shaped or has a parabolic-conical shape and guides the light coming from the laser light source 2 to the luminous element 3. The light-guiding element 9 is designed similarly to a "Compound Parabolic Concentrator", i.e. is reflective on the inner side of the cover thereof such that, in combination with the funnel-type shape, incoming light converges in the direction of the outlet of the light guiding element 9. The total reflection at the boundary surfaces of the light guiding element 9 is utilized in particular. Such a light guiding element 9 makes greater tolerances possible with respect to the relative positioning between the light source 2 and the luminous element 3, for example when the light source 2 is replaced for purposes of repair, or when the laser light source 2 is no longer in the optimal position, due to vibrations that occur during operation.

The light guiding element 9 can also be designed as a continuous optical waveguide between the laser light source 2 and the luminous element 3, and can have, for example, a tubular, conical, or cylindrical shape, or any other shape. In one variant, which is not shown in the figures, the positive lens element 7 and the light guiding element 9 are connected by means of an intermediate part, which is tubular or solid, for example, wherein the positive lens element 7, the light guiding element 9, and the intermediate part can also be designed as a single piece. It is also possible to provide irregularities such as inclusions or microstructures, which redirect or scatter the laser light and make this laser light visible from the outside and thereby function as design elements.

Advantageously, absorbing elements are disposed around such optical or light guiding elements 9 in order to prevent possible reflections of the incoming laser light in the main beam direction 100 of the vehicle headlight 1 and, therefore, to prevent endangering other drivers. The screen element 13 in FIG. 1 is one embodiment of such elements. This screen element prevents such reflectances from being emitted from the vehicle headlight 1. In one variant, or in addition, the aforementioned optical or light guiding elements 9 and absorbing elements, such as the screen element 13, can also be provided with non-reflecting surfaces or can be designed such that these aforementioned elements only reflect or absorb light in the wavelength range of the laser light, but are permeable to visible light and therefore allow the headlight components to be seen. For example, the screen element 13 in FIG. 1 is disposed above a horizontal plane extending through the optical axis 400 of the vehicle headlight 1, between the light guiding element 9 and the cover panel 8. Other solutions known to a person skilled in the art are also possible, however, wherein the only precondition for such devices is that the light functions of the vehicle headlight 1 are not disadvantageously affected.

The screen element 13 can also be designed such that this encloses the entire general-diffuse region of the laser light, for example in the form of a tube having a semicircular cross section ("halfpipe"). In a further variant, this screen element can be semi-reflective and/or can be illuminated by a single light source (e.g. a blue LED), for reasons related to design.

The invention according to the aforementioned embodiments makes it possible to implement a vehicle headlight that can meet the legal requirements, such as ECE, SAE, CCC, etc.

A further advantage of the invention is that the heat dissipated during operation of the laser light source 2 can be utilized. In the exemplary embodiment according to FIG. 1, the laser light source 2 is disposed close to the cover panel 8 and underneath a horizontal plane which, in the installed state of the vehicle headlight 1, extends through the optical axis 400 of the vehicle headlight 1. In FIG. 1, the horizontal plane is normal to the plane of the drawing and extends through the optical axis 400 of the vehicle headlight.

The laser light source 2 is disposed so close to the cover panel 8 that the cover panel 8 can be heated by means of the heat dissipated from the laser light source 2. The dissipated heat can be used to thaw and de-ice the cover panel 8. Depending on the laser light source 2 that is used, or depending on the material of the cover panel 8, etc., a decision must be made as to how close to position the laser light source 2 to the cover panel 8. The ventilation device 16 of the laser light source 2 can be used in a supportive manner in this case by directing the flow of dissipated heat.

A further advantageous variant is shown in FIG. 1, where a design screen element 10 is provided, wherein this design screen element encloses the laser light source 2 for vision protection and is made of plastic, for example. The main purpose of the design screen element 10 is to cover the laser light source 2 in order to ensure that this laser light source is not visible from outside the vehicle headlight 1. The laser light source 2 is positioned accordingly within or below the design screen element 10. The design screen element 10 according to the embodiment presented comprises design screen openings 17 for the passage of the dissipated heat. These design screen openings 17 are advantageously oriented in the direction of the cover panel 8 of the vehicle headlight and, according to one variant, can have a nozzle-type shape, thereby enabling the air flow 18 induced by the heat dissipated from the laser light source 2 to be directed in a targeted manner. In this case, a nozzle-type shape refers to a shape that permits the air flow passing through the design screen openings 17 to be directed in order to fulfill the aforementioned task. It is therefore possible to more efficiently implement thawing and de-icing or, in general, to utilize the heat dissipated by the laser light source 2.

The invention claimed is:

1. A vehicle headlight (1) comprising:

at least one laser light source (2), at least one luminous element (3) configured to be stimulated to emit visible light which can be irradiated by means of the laser light source (2), and at least one imaging optical element, wherein the laser light source (2) is disposed in front of the luminous element (3) as viewed in the main beam direction (100) of the vehicle headlight (1) such that the light from the laser light source (2) radiates in the opposite direction to the main beam direction (100) of the vehicle headlight (1), wherein the at least one imaging optical element is embodied as a reflector (4), wherein the luminous element (3) is disposed in a focal point of the reflector (4), and wherein at least one light guiding element (9) is disposed between the laser light source (2) and the luminous element (3), wherein the at least one light guiding element (9) is substantially funnel-shaped and compensates for deviations in the light from the laser light source (2), and wherein at least one design screen element (10) encloses the laser light source (2) for vision protection, wherein the design screen element (10) comprises at least one design screen opening (17), wherein the at least one design screen opening (17) is in the form of a nozzle, and wherein the at least one design screen opening (17) is oriented in the direction of a cover panel (8) of the vehicle headlight (1).

2. The vehicle headlight (1) according to claim 1, wherein the beam direction (200) of the laser light source (2) extends at an angle (300) between 0° and 90° with respect to the optical axis (400) of the vehicle headlight (1).

3. The vehicle headlight (1) according to claim 1, wherein the laser light source (2) is disposed, relative to the luminous element (3), on an envelope of a right circular cone (11), wherein the tip of the circular cone (11) is located in the luminous element (3), the cone axis (500) extends parallel to the optical axis (400) of the vehicle headlight (1), and the envelope line (12) of the envelope of the cone, on which the laser light source (2) is disposed, extends parallel to the beam direction (200) of the laser light source (2).

4. The vehicle headlight (1) according to claim 3, wherein the luminous element (3) is disposed on the optical axis (400) of the vehicle headlight (1).

5. The vehicle headlight (1) according to claim 1, wherein at least one optical element is disposed between the laser light source (2) and the luminous element (3).

6. The vehicle headlight (1) according to claim 1, wherein the laser light source (2) is disposed underneath a horizontal plane which, in the installed state of the vehicle headlight (1), extends through the optical axis (400) of the vehicle headlight (1).

7. The vehicle headlight (1) according to claim 1, wherein the vehicle headlight (1) comprises a cover panel (8) and the laser light source (2) is disposed adjacent to the cover panel (8) so that the cover panel (8) is heated by the heat dissipated from the laser light source (2).

8. The vehicle headlight (1) according to claim 1, wherein the laser light source (2) comprises at least one heat sink (15) and/or at least one ventilation device (16).

9. The vehicle headlight (1) according to claim 1, wherein at least one screen element (13) is provided as a shield against laser light emerging from the vehicle headlight (1).

10. The vehicle headlight of claim 5, wherein the at least one optical element comprises a positive lens element (7).

* * * * *